US009267728B2

(12) United States Patent
Laible et al.

(10) Patent No.: US 9,267,728 B2
(45) Date of Patent: Feb. 23, 2016

(54) SYSTEM FOR FASTENING A FURNITURE FRONT

(75) Inventors: Karl-Friedrich Laible, Langenau (DE); Helmut Steichele, Lauingen (DE)

(73) Assignee: BSH Hausgeraete GmbH, Munich (DE)

( * ) Notice: Subject to any disclaimer, the term of this patent is extended or adjusted under 35 U.S.C. 154(b) by 1284 days.

(21) Appl. No.: 12/226,380

(22) PCT Filed: Apr. 2, 2007

(86) PCT No.: PCT/EP2007/053193

§ 371 (c)(1),
(2), (4) Date: Oct. 16, 2008

(87) PCT Pub. No.: WO2007/122075

PCT Pub. Date: Nov. 1, 2007

(65) Prior Publication Data

US 2009/0072692 A1 Mar. 19, 2009

(30) Foreign Application Priority Data

Apr. 20, 2006 (DE) ..... 10 2006 018 420

(51) Int. Cl.

| | |
|---|---|
| ***A47B 96/20*** | (2006.01) |
| ***F25D 23/10*** | (2006.01) |
| ***A47B 95/00*** | (2006.01) |
| *F25D 23/02* | (2006.01) |
| *F25D 23/12* | (2006.01) |

(52) U.S. Cl.

CPC ..... *F25D 23/10* (2013.01); *A47B 95/00* (2013.01); *F25D 23/02* (2013.01); *F25D 23/126* (2013.01)

(58) Field of Classification Search

USPC ..... 312/405, 204, 265.5, 265.6, 324, 312/326–329

See application file for complete search history.

(56) References Cited

U.S. PATENT DOCUMENTS

| | | | | |
|---|---|---|---|---|
| 2,219,962 | A * | 10/1940 | Reynolds et al. | 49/479.1 |
| 2,498,139 | A * | 2/1950 | Simjian | 248/467 |
| 2,720,683 | A * | 10/1955 | Schwenker et al. | 49/496.1 |
| 2,936,050 | A * | 5/1960 | McLaughlin | 52/704 |
| 5,077,985 | A | 1/1992 | Buchser et al. | |
| 5,971,213 | A * | 10/1999 | Lee | 222/146.6 |
| 6,948,788 | B1 | 9/2005 | Tai | |
| 7,240,510 | B2 * | 7/2007 | Lee et al. | 62/353 |
| 2004/0183413 | A1 * | 9/2004 | Koo | 312/401 |

(Continued)

FOREIGN PATENT DOCUMENTS

| | | |
|---|---|---|
| EP | 0647821 | * 10/1994 |
| EP | 877215 | * 11/1998 |

(Continued)

OTHER PUBLICATIONS

International Search Report PCT/EP2007/053193.

*Primary Examiner* — Janet M Wilkens

(74) *Attorney, Agent, or Firm* — James E. Howard; Andre Pallapies

(57) ABSTRACT

A system for fastening a furniture front to a door of a built-in refrigerator is provided and includes at least two retaining fittings interposed between the back of the furniture front and the front of the door of the built-in refrigerator. An ice/water dispenser is provided on the door of the built-in refrigerator, the dispenser being actuatable through a recess in the furniture front, and one of the retaining fittings is arranged directly next to the dispenser between the door and the furniture front.

40 Claims, 3 Drawing Sheets

(56) References Cited

U.S. PATENT DOCUMENTS

| | | | | |
|---|---|---|---|---|
| 2004/0183414 | A1* | 9/2004 | Kwon | 312/401 |
| 2006/0065007 | A1 | 3/2006 | Park et al. | |
| 2008/0143227 | A1* | 6/2008 | Kim et al. | 312/405 |
| 2008/0252186 | A1* | 10/2008 | Crompton et al. | 312/204 |
| 2009/0039750 | A1* | 2/2009 | Laible et al. | 312/405 |
| 2009/0045705 | A1* | 2/2009 | Laible et al. | 312/204 |
| 2009/0071184 | A1* | 3/2009 | Buchstab et al. | 62/389 |
| 2009/0282856 | A1* | 11/2009 | Buchstab et al. | 62/389 |
| 2010/0270901 | A1* | 10/2010 | Kim et al. | 312/405 |
| 2010/0295425 | A1* | 11/2010 | Kim | 312/204 |
| 2010/0327720 | A1* | 12/2010 | Pae | 312/405 |

FOREIGN PATENT DOCUMENTS

| | | |
|---|---|---|
| EP | 1145667 | * 10/2001 |
| EP | 1245916 | * 10/2002 |
| GB | 1107996 | * 3/1968 |
| GB | 2050814 | * 1/1981 |

* cited by examiner

SYSTEM FOR FASTENING A FURNITURE FRONT

BACKGROUND OF THE INVENTION

The present invention relates to an arrangement for securing a furniture front to a door of a built-in refrigerator.

Household appliances, such as refrigerators, are now predominantly designed as built-in appliances, which are provided with furniture fronts, to match the design of the built-in appliance to its surroundings. To secure a furniture front to a built-in refrigerator retaining fittings are provided on the furniture front, with which the furniture front can be connected to the door of the refrigerator prepared for this purpose in a detachable and generally adjustable manner.

Built-in refrigerators equipped with an ice/water dispenser IWD in addition to a freezer unit have been available for some time. The ice/water dispenser is generally located around halfway up, in the center between the side edges of the door of the refrigerator, in a correspondingly prepared cutout in the door.

Until now however these types of built-in refrigerator with an ice/water dispenser were only available with doors of a predefined design, for example a stainless steel effect. Integration of the built-in refrigerator into an existing furniture decor predefined by the furniture fronts of the built-in kitchen has hitherto not been possible for such refrigerators with ice/water dispensers.

BRIEF SUMMARY OF THE INVENTION

The object of the invention is to specify an arrangement for securing a furniture front to a built-in refrigerator with an ice/water dispenser.

According to the invention the object is achieved by an arrangement with the features as claimed in claim 1.

With the inventive arrangement it is possible to secure a furniture front to a door prepared for this purpose. To this end the furniture front is provided with a cutout, through which the ice/water dispenser projects when the furniture front is fitted. Two retaining fittings serve to secure the furniture front, one of the retaining fittings being arranged directly adjacent to the ice/water dispenser according to the invention and therefore also directly adjacent to the cutout between the door and the furniture front. The arrangement of the retaining fitting directly adjacent to the cutout means that the furniture front, although weakened by the cutout, is stiffened specifically by the retaining fitting. The retaining fittings used are preferably conventional retaining fittings, which are used for built-in refrigerators without ice/water dispensers. This has the advantage on the one hand that the fitter is already familiar with the nature of the securing means. On the other hand it is not necessary to differentiate between different retaining fittings for different built-in refrigerators.

At least one of the retaining fittings is preferably fitted with at least one positioning element to adjust the relative position of the furniture front to the door of the built-in refrigerator. It is thus possible to align the position of the furniture front in relation to the door and also in relation to adjacent built-in furniture during or even after fitting.

The positioning element for adjusting the relative position of the furniture front to the door of the refrigerator is preferably provided on the retaining fitting arranged directly adjacent to the door of the refrigerator, it being possible to adjust the positioning element through the cutout in the furniture front. The cutout therefore serves not only as an access opening for the ice/water dispenser but at the same time also as a fitting opening, so that the appearance of the furniture front is not adversely affected by additional adjustment openings.

So that the ice/water dispenser does not have to be dismantled to adjust the furniture front, it is also advantageous with the exemplary embodiment described above if at least one access opening is provided at the dispenser for adjusting the positioning element. The access openings can be covered by an insert held in the dispenser, which is simply removed to adjust the furniture front and then put back into position.

The positioning element used is preferably a double-threaded bolt with a nut, the one thread screwing into the retaining fitting secured to the furniture front or the door and being held in the adjusted position with the nut. Very simple and precise adjustment of the furniture front is possible with the aid of this positioning element.

In one preferred embodiment of the inventive arrangement it is proposed that the retaining fitting arranged directly adjacent to the dispenser is connected in a fixed manner to the rear face of the furniture front. A fixed connection here means that the retaining fitting is secured to the rear face of the furniture front in a predefined position, for example by screwing, and its position does not change during fitting or any adjustment. The fixed connection of the retaining fitting to the furniture front means that the furniture front is stiffened particularly effectively, in particular in the region of the cutout.

The inventive securing arrangement can be used for different designs when configuring furniture fronts for built-in refrigerators with ice/water dispensers.

It is therefore proposed, when using a furniture front formed from a single panel, with which the cutout is an opening configured in the panel, through which the dispenser can be actuated, that the retaining fitting should be secured to the furniture front directly adjacent to the dispenser in proximity to the opening.

Even in the case of a furniture front formed from two panels arranged at a distance from one another, which form the upper and lower edges of the cutout for the dispenser, which is also configured as an opening here, with the lateral edges of the opening being formed by two lateral elements which connect the panels to one another, the retaining fitting is preferably arranged directly adjacent to the dispenser and secured to the furniture front in proximity to the opening, in order to achieve the greatest possible rigidity of the furniture front.

If however the furniture front is formed from two panels, which have to be secured to the door of the built-in refrigerator independently of one another, with a cover arranged between the two panels being provided on the front face of the door of the refrigerator, said cover being provided with an opening for actuating the dispenser, the panels are secured to the door independently of one another with at least one retaining fitting respectively, the retaining fittings of both panels preferably being fitted with a positioning element for adjustment purposes and the retaining fitting of the lower panel being arranged directly adjacent to the dispenser to facilitate adjustability.

So that the stiffening effect of the retaining fitting on the furniture front is as great as possible, it is also proposed that a rail be used as the retaining fitting, extending over approximately the entire width of the furniture front.

Further details and advantages of the invention will emerge from the subclaims in conjunction with the description of an exemplary embodiment, which is described in detail with reference to the drawing, in which:

DETAILED DESCRIPTION OF THE PRESENT INVENTION

Figure 1:
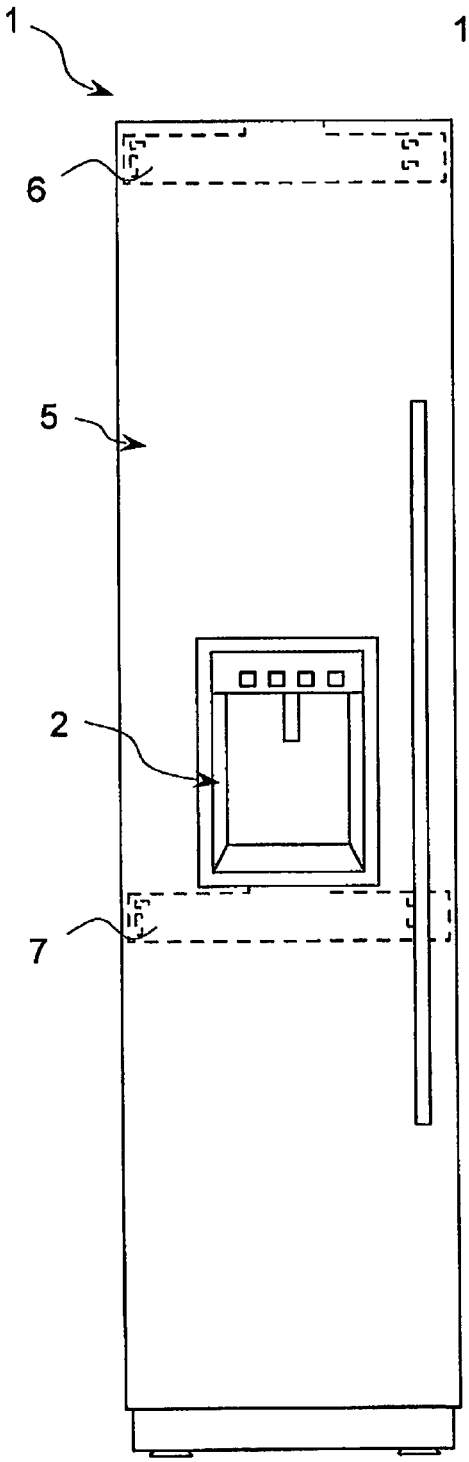
FIG. 1 shows a front view of a first exemplary embodiment of a built-in refrigerator with an ice/water dispenser and a furniture front secured thereto according to the invention.
Figure 2:
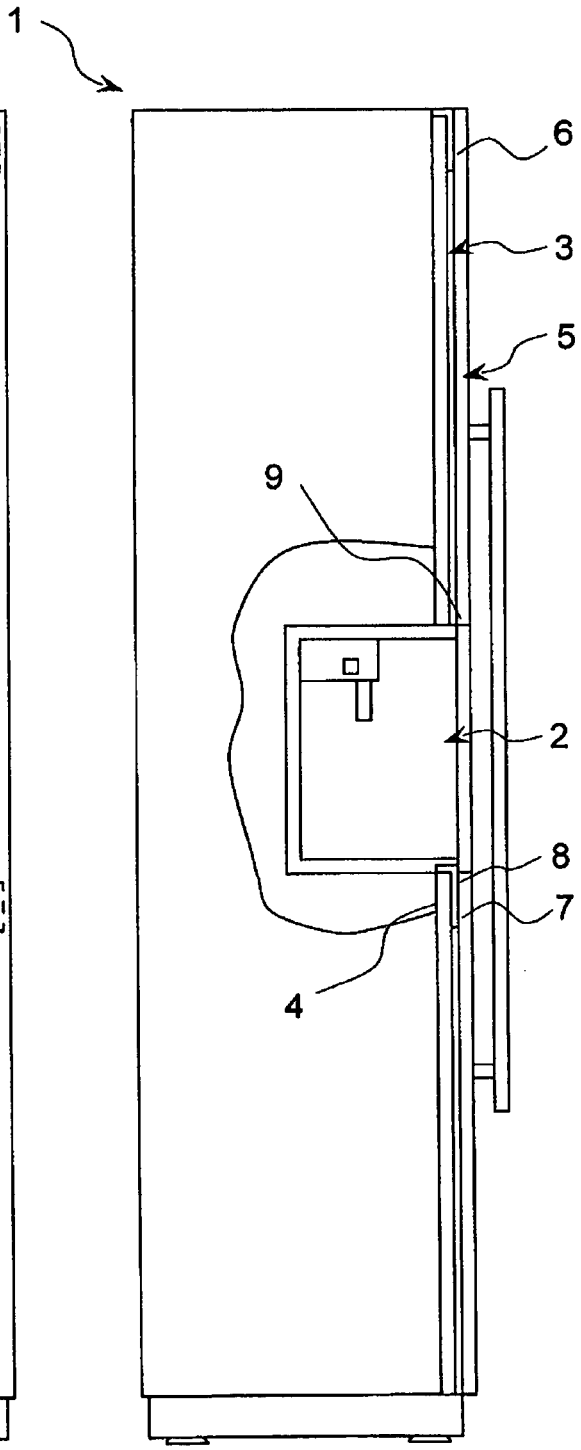
FIG. 2 shows a side view of the built-in refrigerator shown in FIG. 1 with a segment cut out in the region of the ice/water dispenser.

FIGS. 1 and 2 show a front view and side view of a built-in refrigerator 1 with an ice/water dispenser 2. As shown in FIG. 2, the refrigerator 1 has a door 3, in the center of which a cutout 4 is provided around halfway up, in which the ice/water dispenser 2 is fitted.

A furniture front 5 is secured to the door 3 of the refrigerator 1 by retaining fittings 6 and 7 shown with a broken line in FIG. 1. An opening 8 is provided in the region of the ice/water dispenser 2, through which the ice/water dispenser 2 and its housing 9 project, terminating roughly flush with the furniture front 5. The retaining fittings 6 and 7, which are configured identically, are retaining fittings as used with conventional built-in refrigerators without ice/water dispensers.

Figure 3:
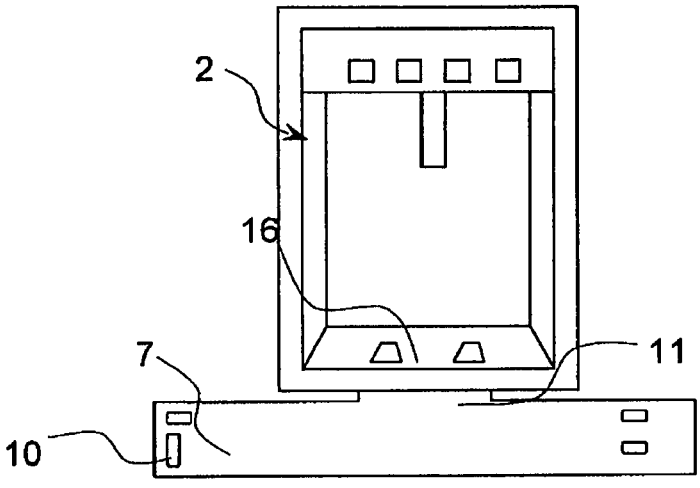
FIG. 3 shows an enlarged diagram of a segment, in which the ice/water dispenser is shown with a retaining fitting arranged below it.

As shown in FIG. 3, in which the lower retaining fitting 7 is shown, the retaining fittings 6 and 7 are configured as metal strips, which extend approximately over the entire width of the furniture front 5 and are stiffened in the known manner by a number of ridges and depressions (not shown). A number of longitudinal holes 10 are also provided to secure the retaining fitting 6 or 7 to the rear face of the furniture front 5 with screws (not shown). A tongue 11 is formed on the upper longitudinal edge of each retaining fitting 6 and 7 shown in FIGS. 1 and 2, being bent at approximately a right angle to the flat face of the retaining fitting 6 and 7 (see FIGS. 3 and 4). Two threads are provided on the tongue 11, for screwing in the double-threaded bolts 12 serving as positioning elements (see FIG. 4).

For fitting purposes the two retaining fittings 6 and 7 are first secured to the rear face of the furniture front 5 by screws. The upper retaining fitting 6 is secured to the furniture front 5 in such a manner that its bent tongue 11 rests on the upper edge of the door 3 of the refrigerator 1.

Figure 4:
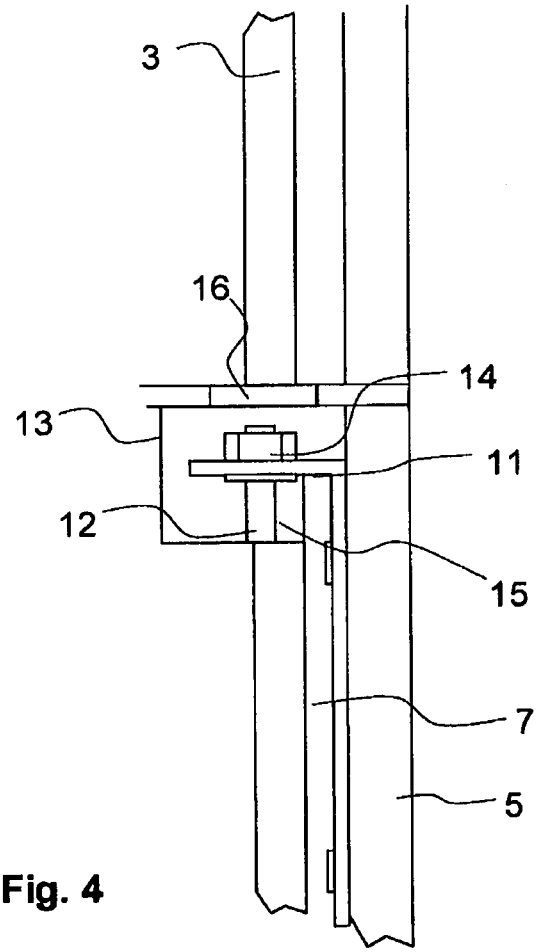
FIG. 4 shows a detailed cross-section, showing a side view of the double thread with nut used as a positioning element to adjust the furniture front.

The lower retaining fitting 7 is secured to the furniture front 5 in such a manner that when the furniture front 5 is fitted, said lower retaining fitting 7 is arranged directly below the ice/water dispenser 2. As shown in FIG. 4, its tongue 11 then projects into a recess 13 formed in the door 2 below the ice/water dispenser 2.

To adjust the furniture front 5, the upper retaining fitting 6 is first secured to the door 3 with some clearance. The relative position of the furniture front 5 is then adjusted in relation to the door 3 with the aid of nuts 14 and bracing elements 15, which are screwed onto the double-threaded bolts 12. To this end the double-threaded bolts 12 are screwed into the thread of the tongue 11, until they are braced in the recess 13. The relative position of the furniture front 5 to the door 3 is then adjusted by turning the double-threaded bolts 12 and securing their position by tightening the nuts 14. The screws (not shown) of the upper retaining fitting 6 are then tightened. In order to be able to adjust the double-threaded bolts 12 and nuts 14, two fitting openings 16 are provided in the housing 9 of the ice/water dispenser 2 (see FIGS. 3 and 4), these being resealed by means of an insert (not shown) when the furniture front 5 has been fitted and adjusted.

The lower retaining fitting 7 has two functions. On the one hand the retaining fitting 7 serves as a stiffening element, to stiffen the furniture front 5 which has been weakened by the opening 8. On the other hand the lower retaining fitting serves as an adjusting facility, which can be used to adjust the relative position of the furniture front 5 to the door 3.

Figure 5:
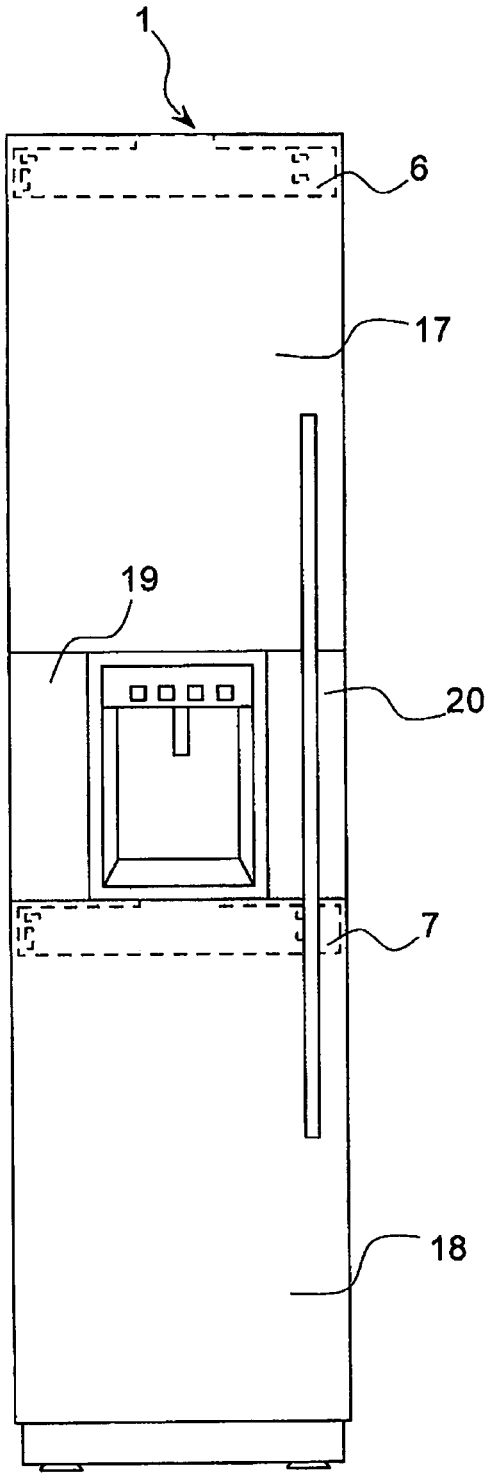
FIG. 5 shows a front view of a first modification of the built-in refrigerator according to FIG. 1, in which the furniture front is formed from two panels, which are connected to one another by lateral elements and the furniture front is secured in the inventive manner to the door of the built-in refrigerator.
Figure 6:
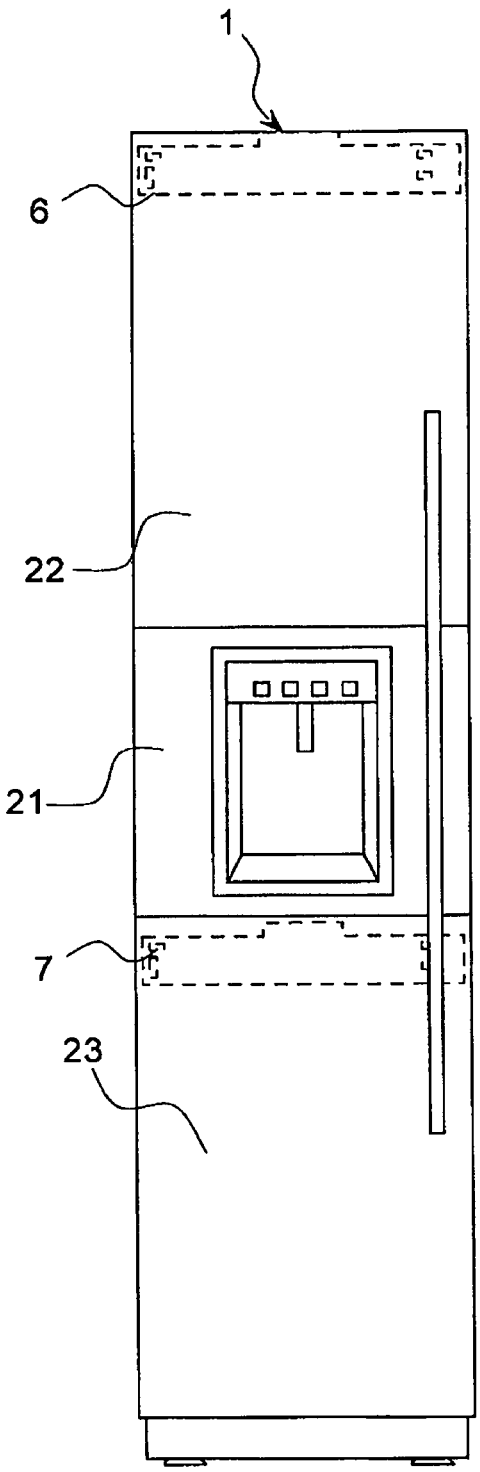
FIG. 6 shows a front view of a second modification of the built-in refrigerator according to FIG. 1, in which the furniture front is formed from panels configured independently of one another, which are secured in the inventive manner to the door of the built-in refrigerator.

FIGS. 5 and 6 show two modifications of the built-in refrigerator 1. In the first modification shown in FIG. 5 the furniture front 5 is formed by two panels 17 and 18, which are connected in a fixed manner to one another by two lateral elements 19 and 20, the opening 8 being bounded by the upper and/or lower edge of the panels 17 and 18 and the edges of the lateral elements 19 and 20 facing one another. Securing is effected by way of the two retaining fittings 6 and 7 here too.

FIG. 6 shows a second modification of the built-in refrigerator 1, in which a stainless steel insert 21 is secured to the door 3 around the ice/water dispenser 2, forming the visible surface of the refrigerator 1 with the fitted furniture front 5. In this exemplary embodiment the furniture front 5 is formed from two panels 22 and 23, which are secured to the door 3 by the two retaining fittings 6 and 7 independently of one another.

The invention claimed is:

1. An arrangement securing a furniture front to a door of a built-in refrigerator, the arrangement comprising:

a first retaining fitting; and a second retaining fitting secured directly to the furniture front, the pair of retaining fittings being disposable between a rear face of the furniture front and the front face of the door of the built-in refrigerator for assisting in retaining the furniture front on the door of the built-in refrigerator in a disposition in which an ice/water dispenser provided in a recess of the door of the built-in refrigerator can be actuated through a cutout in the furniture front; and one of the pair of the retaining fittings being disposable directly adjacent to the ice/water dispenser between the door and the furniture front, wherein the retaining fitting disposed adjacent to the dispenser comprises a tongue projecting into the recess below the dispenser.

2. The arrangement as claimed in claim 1, wherein at least one of the retaining fittings has at least one positioning element to adjust the relative position of the furniture front to the door of the built-in refrigerator.

3. The arrangement as claimed in claim 2, wherein the at least one positioning element is provided on the retaining fitting;

the retaining fitting is arranged directly adjacent to the dispenser; and the positioning element can be adjusted through the cutout in the furniture front.

4. The arrangement as claimed in claim 3, wherein at least one access opening is provided at the dispenser for adjusting the positioning element.

5. The arrangement as claimed in claimed 3, wherein the positioning element is a double-threaded bolt with a nut, the one thread being screwed into the retaining fitting, and the retaining fitting is secured to the furniture front or door and the furniture front or door is held by the nut.

6. The arrangement as claimed in claim 1, wherein the retaining fitting arranged directly adjacent to the dispenser is connected in a fixed manner to the rear face of the furniture front.

7. The arrangement as claimed in claim 1, wherein the furniture front is formed from a single panel, the cutout is an opening configured in the panel, through which the dispenser can be actuated, and the retaining fitting arranged directly adjacent to the dispenser is secured to the furniture front in proximity to the opening.

8. The arrangement as claimed in claim 1, wherein the furniture front is formed from two panels arranged at a distance from one another, which bound the upper and lower edges of the cutout for the dispenser, formed as an opening, the lateral edges of the opening are formed by two lateral elements which connect the panels to one another and the retaining fitting is arranged directly adjacent to the dispenser and is secured to the furniture front in proximity to the opening.

9. The arrangement as claimed in claim 1, wherein the furniture front is formed from two panels, which are secured to the door of the built-in refrigerator independently of one another, a cover arranged between the two panels is arranged on the front face of the door, which is provided with an opening for actuating the dispenser and the panels are secured to the door independently of one another with a retaining fitting respectively, the retaining fitting of the lower panel being arranged directly adjacent to the dispenser.

10. The arrangement as claimed in claim 1, wherein the retaining fitting arranged in proximity to the dispenser is a rail that extends approximately over the entire width of the furniture front.

11. The arrangement as claimed in claim 1, further comprising at least one screw to directly secure the second retaining fitting to the furniture front.

12. The arrangement as claimed in claim 1, wherein arrangement comprises at least one positioning element and at least one corresponding thread on the tongue, and the positioning element is attached to the tongue through the thread so as to fasten the retaining fitting to the door.

13. The arrangement as claimed in claim 12, wherein the positioning element is a double-threaded bolt with a nut, the one thread being screwed into the retaining fitting, and the retaining fitting is secured to the furniture front and door.

14. The arrangement as claimed in claim 1, wherein the tongue is formed along an upper longitudinal edge of the retaining fitting arranged directly adjacent to the dispenser.

15. The arrangement as claimed in claim 14, wherein the tongue is bent at approximately a right angle from said retaining fitting.

16. An arrangement securing a furniture front to a door of a built-in refrigerator, the arrangement comprising:

a first retaining fitting; and a second retaining fitting secured directly to the furniture front, the pair of retaining fittings being disposable between a rear face of the furniture front and the front face of the door of the built-in refrigerator for assisting in retaining the furniture front on the door of the built-in refrigerator in a disposition in which an ice/water dispenser provided in a recess of the door of the built-in refrigerator can be actuated through a cutout in the furniture front and one of the pair of the retaining fittings being disposable directly adjacent to the ice/water dispenser between the door and the furniture front, wherein the retaining fitting arranged directly adjacent to the dispenser comprises a tongue formed along an upper longitudinal edge of said retaining fitting, and wherein said retaining fitting is secured to the furniture front in proximity to the opening, and is secured to the door via the tongue, and wherein the tongue is arranged such that it projects into the recess of the door below the dispenser; and wherein the furniture front includes only a single panel, the cutout is an opening configured in the panel, through which the dispenser can be actuated.

17. The arrangement as claimed in claim 16, wherein at least one of the retaining fittings has at least one positioning element to adjust the relative position of the furniture front to the door of the built-in refrigerator.

18. The arrangement as claimed in claim 16, wherein the at least one positioning element is provided on the retaining fitting;

the retaining fitting is arranged directly adjacent to the dispenser; and the positioning element can be adjusted through the cutout in the furniture front.

19. The arrangement as claimed in claim 18, wherein at least one access opening is provided at the dispenser for adjusting the positioning element.

20. The arrangement as claimed in claimed 18, wherein the positioning element is a double-threaded bolt with a nut, the one thread being screwed into the retaining fitting, and the retaining fitting is secured to the furniture front or door and the furniture front or door is held by the nut.

21. The arrangement as claimed in claim 16, wherein the retaining fitting arranged directly adjacent to the dispenser is connected in a fixed manner to the rear face of the furniture front.

22. The arrangement as claimed in claim 16, wherein the retaining fitting arranged in proximity to the dispenser is a rail that extends approximately over the entire width of the furniture front.

23. The arrangement as claimed in claim 16, further comprising at least one screw to directly secure the second retaining fitting to the furniture front.

24. The arrangement as claimed in claim 16, wherein the tongue is bent at approximately a right angle from said retaining fitting.

25. An arrangement for securing a furniture front to a door of a built-in refrigerator, the arrangement comprising:

a first retaining fitting; and a second retaining fitting adapted to be secured directly to the furniture front, the pair of retaining fittings adapted to be disposed between a rear face of the furniture front and a front face of the door of the built-in refrigerator for assisting in retaining the furniture front on the door of the built-in refrigerator in a disposition in which an ice/water dispenser adapted to be provided in a recess of the door of the built-in refrigerator can be actuated through a cutout in the furniture front; and one of the pair of the retaining fittings is adapted to be disposed directly adjacent to the ice/water dispenser between the door and the furniture front, wherein the retaining fitting adapted to be disposed adjacent to the dispenser comprises a tongue configured to project into the recess below the dispenser.

26. The securing arrangement of claim 25, wherein at least one of the retaining fittings has at least one positioning element so as to permit adjustment of the relative position of the furniture front to the door of the built-in refrigerator.

27. The securing arrangement of claim 26, wherein the at least one positioning element is provided on the retaining fitting adapted to be disposed adjacent to the dispenser; and the positioning element is adapted to be adjusted through the cutout in the furniture front.

28. The securing arrangement of claim 27, wherein the positioning element is adapted to be adjusted through at least one access opening that may be provided at the dispenser.

29. The securing arrangement of claim 27, the arrangement comprising at least one thread being screwed into the retaining fitting, wherein the positioning element is a double-threaded bolt with a nut, and the retaining fitting is adapted to be secured to the furniture front or door, and the furniture front or door is adapted to be held by the nut.

30. The securing arrangement of claim 25, wherein the retaining fitting adapted to be arranged directly adjacent to the dispenser is further adapted to be connected in a fixed manner to the rear face of the furniture front.

31. A combination comprising a furniture front and the securing arrangement of claim 25, wherein the furniture front is formed from a single panel.

32. The combination of claim 31, wherein the cutout is an opening configured in the panel, through which the dispenser can be actuated, and the retaining fitting adapted to be arranged directly adjacent to the dispenser is secured to the furniture front in proximity to the opening.

33. A combination comprising a furniture front and the securing arrangement of claim 25, wherein the furniture front is formed from two panels.

34. The combination of claim 33, wherein the two panels are arranged at a distance from one another, and bound upper and lower edges of the cutout for the dispenser, formed as an opening, the lateral edges of the opening are formed by two lateral elements which connect the panels to one another and the retaining fitting adapted to be arranged directly adjacent to the dispenser is secured to the furniture front in proximity to the opening.

35. The combination of claim 33, wherein the two panels are secured to the door of the built-in refrigerator independently of one another, a cover arranged between the two panels is arranged on the front face of the door, which is provided with an opening for actuating the dispenser and the panels are secured to the door independently of one another with a retaining fitting respectively, the retaining fitting of the lower panel being arranged directly adjacent to the dispenser.

36. The securing arrangement of claim 25, wherein the retaining fitting adapted to be arranged in proximity to the dispenser is a rail that is configured to extend approximately over the entire width of the furniture front.

37. The securing arrangement of claim 25, further comprising at least one screw adapted to directly secure the second retaining fitting to the furniture front.

38. An arrangement for securing a furniture front to a door of a built-in refrigerator, the arrangement comprising:

a first retaining fitting; and a second retaining fitting adapted to be secured directly to the furniture front, the pair of retaining fittings adapted to be disposed between a rear face of the furniture front and a front face of the door of the built-in refrigerator for assisting in retaining the furniture front on the door of the built-in refrigerator in a disposition in which an ice/water dispenser adapted to be provided in a recess of the door of the built-in refrigerator can be actuated through a cutout in the furniture front and one of the pair of the retaining fittings is adapted to be disposed directly adjacent to the ice/water dispenser between the door and the furniture front; and wherein the retaining fitting adapted to be arranged directly adjacent to the dispenser comprises a tongue formed along an upper longitudinal edge of said retaining fitting, and wherein said retaining fitting is adapted to be secured to the furniture front in proximity to the opening, and said retaining fitting is adapted to be secured to the door via the tongue, and wherein the tongue is adapted to be arranged such that it projects into the recess of the door below the dispenser.

39. A combination comprising a furniture front and the securing arrangement of claim 38, wherein the furniture front is only a single panel, the cutout is an opening configured in the panel, through which the dispenser can be actuated.

40. A combination comprising a furniture front and the securing arrangement of claim 38, wherein the furniture front is formed from two panels.

* * * * *